United States Patent [19]

Dew et al.

[11] 4,062,405

[45] Dec. 13, 1977

[54] METHOD OF TREATING OIL-BEARING FORMATION USING MOLTEN SULFUR INSULATING

[75] Inventors: John N. Dew; Donald L. Whitfill, both of Ponca City; Robert E. Crumb, Seminole, all of Okla.

[73] Assignee: Continental Oil Company, Ponca City, Okla.

[21] Appl. No.: 743,560

[22] Filed: Nov. 22, 1976

[51] Int. Cl.[2] ..... E21B 43/24

[52] U.S. Cl. ..... 166/272; 166/303; 166/57

[58] Field of Search ..... 166/302, 303, 57, 288, 166/272

[56] References Cited

U.S. PATENT DOCUMENTS

| | | | |
|---|---|---|---|
| 978,359 | 12/1910 | Cooper | 166/288 |
| 2,341,573 | 2/1944 | Reed | 166/288 |
| 3,380,530 | 4/1968 | McConnell et al. | 166/57 X |
| 3,397,745 | 8/1968 | Owens et al. | 166/57 |
| 3,438,442 | 4/1969 | Pryor et al. | 166/57 X |
| 3,498,381 | 3/1970 | Earlougher, Jr. | 166/57 X |
| 3,525,399 | 8/1970 | Bayless et al. | 166/57 X |
| 3,557,871 | 1/1971 | Parker | 166/57 |
| 3,827,978 | 8/1974 | Miles | 166/57 X |
| 3,851,704 | 12/1974 | Maxon et al. | 166/57 X |
| 3,861,469 | 1/1975 | Bayless et al. | 166/57 X |

OTHER PUBLICATIONS

Willhite et al., "Use of an Insulating Fluid for Casing Protection During Steam Injection", Jour. Pet. Tech., vol. 19, No. 11, Nov. 1967, pp. 1453–1456.

"Handbook of Chemistry and Physics", 55th Ed., 1974–1975, CRC Press, Cleveland, Ohio, pp. E-2 to E-5, E-12, E-15, E-17.

*Primary Examiner*—Stephen J. Novosad

*Attorney, Agent, or Firm*—Cortlan R. Schupbach, Jr.

[57] ABSTRACT

Molten elemental sulfur is used as an insulating packer fluid in injection wells for steam drive secondary recovery of petroleum from petroliferous formations.

5 Claims, 2 Drawing Figures

VISCOSITY-TEMPERATURE CURVE FOR LIQUID SULFUR

METHOD OF TREATING OIL-BEARING FORMATION USING MOLTEN SULFUR INSULATING

Figure 1:
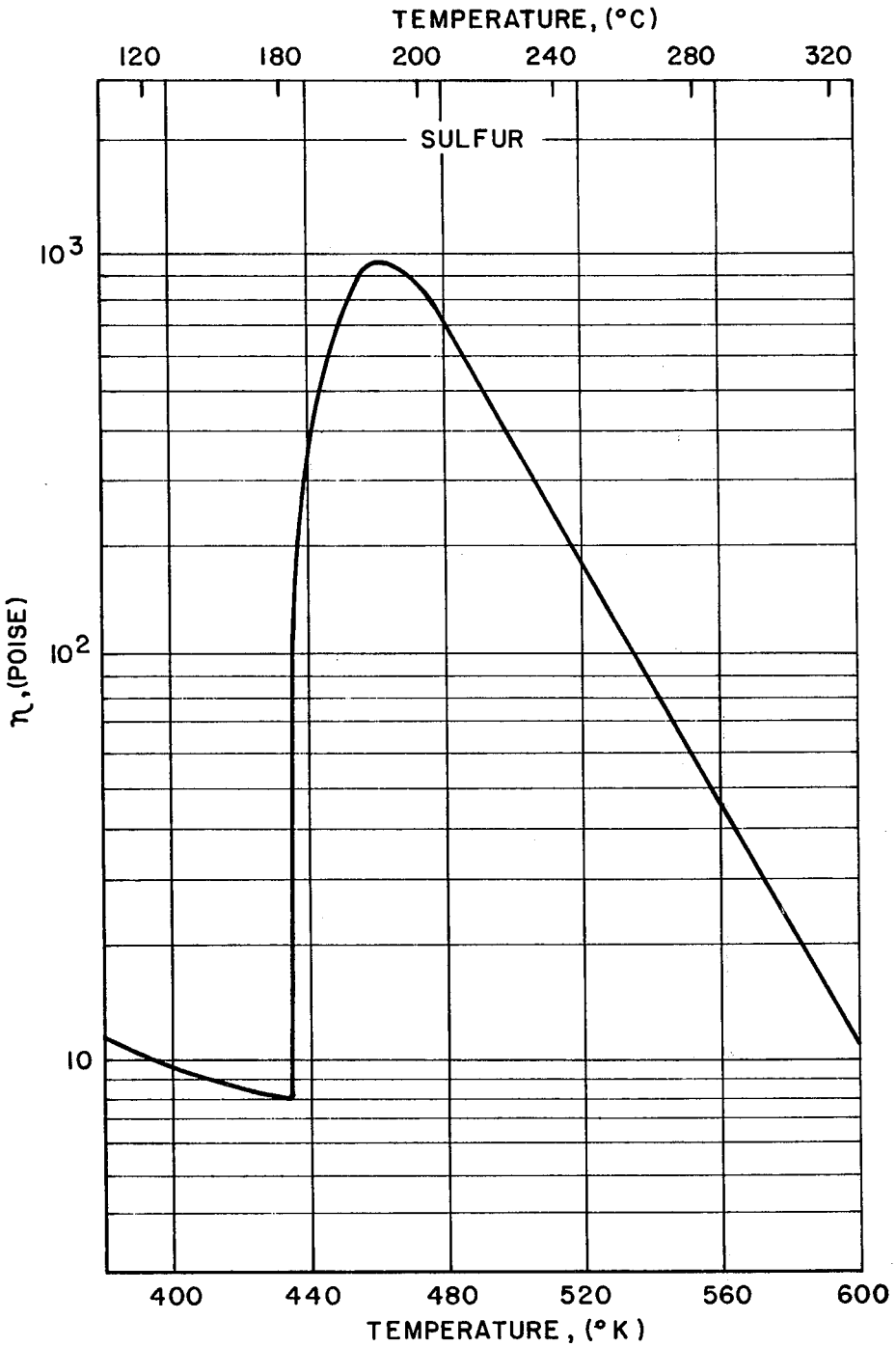

The present invention relates to a method for preventing heat loss during secondary recovery of petroleum from petroliferous formations. More particularly, the present invention relates to the use of molten elemental sulfur as an insulating packer fluid to prevent heat loss to surrounding formations.

As reserves of available petroleum have declined, it has become necessary to employ secondary and even tertiary recovery techniques to existing formations in order to maximize such recovery. One well-known method of secondary recovery is the injection of steam into a petroliferous formation in order to recover petroleum not available to primary recovery techniques.

One form of secondary recovery which has been largely successful in the oil industry is a process of injecting steam through a well into the petroleum reservoir. The process utilizes a thermal drive where steam is injected into one well which drives oil before it to a second producing well. Alternatively, a single well can be used for both steam injection and production of oil by a method commonly known as "huff and puff". The steam is injected through the well tubing and into the formation. Injection is then interrupted and the well is permitted to heat-soak for a period of time, following which the well is placed on a production cycle and heated fluids are withdrawn by way of the well to the surface.

Steam injection increases oil production since the viscosity of most oil is strongly dependent upon the temperature of the oil. In many cases, the viscosity of the reservoir oil can be reduced by several hundred-fold if the temperature of the oil is increased several hundred degrees. This is particularly true where such oils exist in thick, low permeability sands where present fracturing techniques are not effective. Even a minor reduction in the viscosity of the reservoir oil can sharply increase productivity. Steam injection is also useful in overcoming well bore damage at injection and producing wells. Such damage often occurs because of asphaltic or paraffinic components of the crude oil which clogs the pore spaces of the reservoir sand immediately surrounding the well.

Injection of high temperature steam, reaching temperatures of 650° F or even higher, does present special operation problems. Whenever the steam is injected through the tubing, there is substantial transfer of heat across the annular space to the well casing, and thence into the surrounding formation. The heating can produce thermally induced stresses resulting in casing failure in addition to the loss of the thermal energy as the steam travels through the tubing string. Thus, a common occurrence is for the superheated steam to be merely hot water at the bottom of the well initially and for the surrounding formation to reach a certain temperature before substantial thermal energy reaches the petroliferous formation. This condensation and heat transfer represents a tremendous loss in the amount of thermal energy that the injected fluid is able to carry into the producing reservoir. These techniques are well-known and are adequately represented with reference to U.S. Pat. Nos. 3,352,359, and 3,380,530.

Such methods, while effective, none the less are expensive due to the heat loss between the well casing and the surrounding formation when steam is injected into the well. It is therefore necessary that some sort of insulating material be placed in the well in order to prevent excessive heat loss to surrounding formations above the oil-bearing petroliferous formation. Many materials and apparatus have been devised for such a purpose. Representative of these are U.S. Pat. No. 3,438,422 which teaches the use of an insulated pre-stressed tubing string. U.S. Pat. No. 3,525,399 teaches the use of a silicate foam in a well bore. U.S. Pat. No. 3,557,871 teaches filling the annulus between the tubing and the casing string with water and soluble inorganic salts such as borax or sodium carbonate, thus forming a substantial coat of the salt in solid form on the walls of the annulus. In addition to these, other proposals such as forming a dead, closed gas space using a bitumastic coating, inert gas and heat reflector systems have been proposed. All such methods are expensive and successful only to varying degrees.

It is therefore an object of the present invention to provide an insulating material which is convenient, recoverable, and prevents excessive heat transfer during steam injection into secondary recovery wells. Other objects will become apparent to those skilled in this art as the description proceeds.

It has now been discovered that elemental sulfur, when molten, forms an excellent insulating packer fluid in the annulus between a well casing and an inner tubing when high temperature treating fluid is being conducted to a sub-surface petroliferous formation through a well bore which is lined with a casing.

The Frasch process for recovering sulfur is well-known. The process has been improved as described in U.S. Pat. Nos. 1,878,158 and 2,754,098. All these processes have in common the fact that elemental molten sulfur is recovered by the use of steam. However, the references do not contain any suggestion that sulfur itself can act as an insulating fluid, although U.S. Pat. No. 1,878,158 does state that sulfur can change in viscosity at various temperatures.

While certain of the insulating techniques hereto described have been effective, they are without exception expensive. For example, pre-stressed insulating tubing strings cost about ten dollars ($10) per foot or $40,000 for a 4,000 foot well. The need for a less expensive means of providing effective well bore insulation is thus apparent.

The use of molten elemental sulfur as described in the instant invention has several beneficial effects. The molten sulfur is a liquid insulating material which is easy to handle and inexpensive to place. Sulfur will develop high viscosity while in place, thus maintaining heat losses due to convection currents at a minimum. In addition, sulfur is an ideal insulating fluid for the purposes of the instant invention since it has low viscosity at lower temperatures for ease of pumping and placement, but developes higher viscosities while in place to prevent convective heat losses. Orthorombic sulfur, when heated in a sealed evacuated tube, first melts to a pale, yellow liquid of low viscosity at about 225° F. Most properties of this liquid show no unusual behavior in the temperature range up to around 320° F. At this temperature, there is a quite abrupt and very large increase in viscosity followed by a gradual decrease at yet higher temperatures. These viscosity changes are perfectly reversible. The change in viscosity for liquid sulfur in relation to temperature is shown in FIG. 1. It can be seen that at temperatures between about 160° to about 280° C that sulfur increases rapidly in viscosity.

Sulfur has an additional advantage over materials of the prior art. When work on the well is necessary, the sulfur can be easily removed in contrast to some insulating materials such as silicate foam which tend to set up and become hard and immovable under use.

The viscosity of molten sulfur at various temperatures, as compared to water (water = 1) is shown in Table 1 below.

Table 1

VISCOSITY DATA FOR MOLTEN SULFUR

| Temp (° F) | Viscosity (Centipoise) |
|---|---|
| 248 | 11 |
| 338 | 30,000 |
| 369 | 52,000 |
| 392 | 46,000 |
| 464 | 24,000 |
| 482 | 9,600 |
| 572 | 2,200 |
| 752 | 150 |
| 838 | 74 |

At various temperatures, the thermal conductivity of liquid sulfur remains relatively constant. An example of thermal conductivity over nearly a 200° F temperature range is shown in Table 2.

Table 2

THERMAL CONDUCTIVITY OF LIQUID SULFUR

| ° F | K [B.T.U./(hr) (ft) (° R)][1] |
|---|---|
| 239 | 0.0750 |
| 248 | .0750 |
| 284 | .0774 |
| 320 | .0798 |
| 329 | .0798 |
| 338 | .0822 |
| 374 | .0870 |
| 410 | 0.0895 |

[1]degrees Rankin

In addition, the heat loss of sulfur when compared to other well-known insulating fluids used in the secondary recovery of petroleum from petroliferous formations is shown in Table 3.

Table 3

SUMMARY OF HEAT LOSS CALCULATIONS

| | $U_2$ BTU/ Hr Ft² ° F | $U_2$ BTU/ Hr Ft ° F | Instantaneous Heat Loss, % of Injected(3) |
|---|---|---|---|
| High Pressure Nitrogen Annulus | 5.42 | 4.08 | 22.2 |
| with Aluminum Paint | 4.56 | 3.43 | 20.8 |
| Low Pressure Nitrogen Annulus | 4.11 | 3.09 | 20.0 |
| with Aluminum Paint | 2.12 | 1.60 | 14.4 |
| Water Annulus (No Boiling Considered) | ≅8.5 | 6.40 | 25.4 |
| Hypothetical Crude Oil(1) | 6.5 | 4.89 | 23.5 |
| Ken Pak(4) | 1.4 | 1.05 | 11.1 |
| Conoco Insulating Fluid | >1.4 | >1.05 | >11.1 |
| with Diatomaceous Earth (Estimates) | 0.67 | 0.50 | 6.4 |
| Sodium Silicate Foam | 0.58 | 0.44 | 5.6 |
| Radiation Shield (Summit Stream Products) | ≅1.50 | 1.13 | 11.6 |
| Insulated Tubing String | 0.83 | 0.36 | 6.5 |
| with Uninsulated Joints(2) | 1.52 | 0.95 | 10.3 |
| Sulfur Annulus (Ke = 0.08 BTU/hr ft ° F) | 0.76 | 0.57 | 7.0 |

(1)Bentone Grease No. 2 insulating fluid has not been field tested but is estimated to cost one-half as much as Ken Pak.
(2)Based on 2 ⅞-in. injecton string. All other injection strings were 2 ⅞-in.
(3)Based on 4,000 ft. depth and 1,000 bbl/day of 650° F, 80% quality steam ($14.1 \times 10^6$ BTU/hr) injected for one year. Average earth temperature around well bore is assumed to be 100° F.
(4)Commercial gelled oil packer fluid marketed by IMCO Services.

The form in which the sulfur is injected into the well is not critical. However, for purposes of convenience, molten sulfur may be preferred. Sulfur in powder or crystal form which is placed into annulus will, of course, absorb heat and become molten before performing its insulating properties so that it may be desirable to pre-heat the sulfur. It will be apparent that the sulfur can be removed from the annulus for well maintenance or for reuse. Sulfur is, in comparison to the other materials used in the prior art, less expensive and as shown from the data incorporated herein, performs an efficient heat insulating function. Since most of the heat loss in the well will occur at the top, it is preferred to inject the sulfur at as high a temperature as possible. As seen on the graph in FIG. 1, the sulfur would be injected at temperatures of around 600° F. The sulfur will gain its highest state of elasticity as it cools, thus performing its insulating function most efficiently.

The invention is more concretely described with reference to the example below wherein all parts and percentages are by weight unless otherwise specified. It is emphasized that the example is for purposes of illustration only and does not limit the instant invention.

EXAMPLE

The insulating effect of sulfur was calculated based on a 10-inch bore hole 5,000 feet deep, cased with a 7-inch casing (J-55, inside diameter 6.276 inches weighing 26 pounds per foot) containing therein a 2⅞ inch tubing (J-55, I.D.2.441 inches weighing 6.4 pounds per foot). The sulfur is equated to 0.08 BTU's per hour, per foot, per degrees F, and the cement is equated to 0.3 BTU's per hour, per foot per degree F. Using 1,000 barrels of water heated to 650° F and a $U_2$ of 2TR × U. Heat loss can be calculated according to the following equation:

$$Q - C(t_1 t_2) aT/d \qquad \text{(a.)}$$

$C$ = Calories
$t$ = ° C
$a$ = cm²
$T$ = seconds
$d$ = cm

In English units, if the heat loss equation is in BTU's, the equation reads as follows:

$$Q = K(t_1 t_2)aT/d \quad \text{(b.)}$$

$C$ = BTU
$t$ = °F
$a$ = ft²
$T$ = hours
$d$ = ft

Using these equations as the basis of the calculation, it can be seen from the data in Table 3 that sulfur is extremely effective when compared to the compounds of the prior art.

Figure 2:
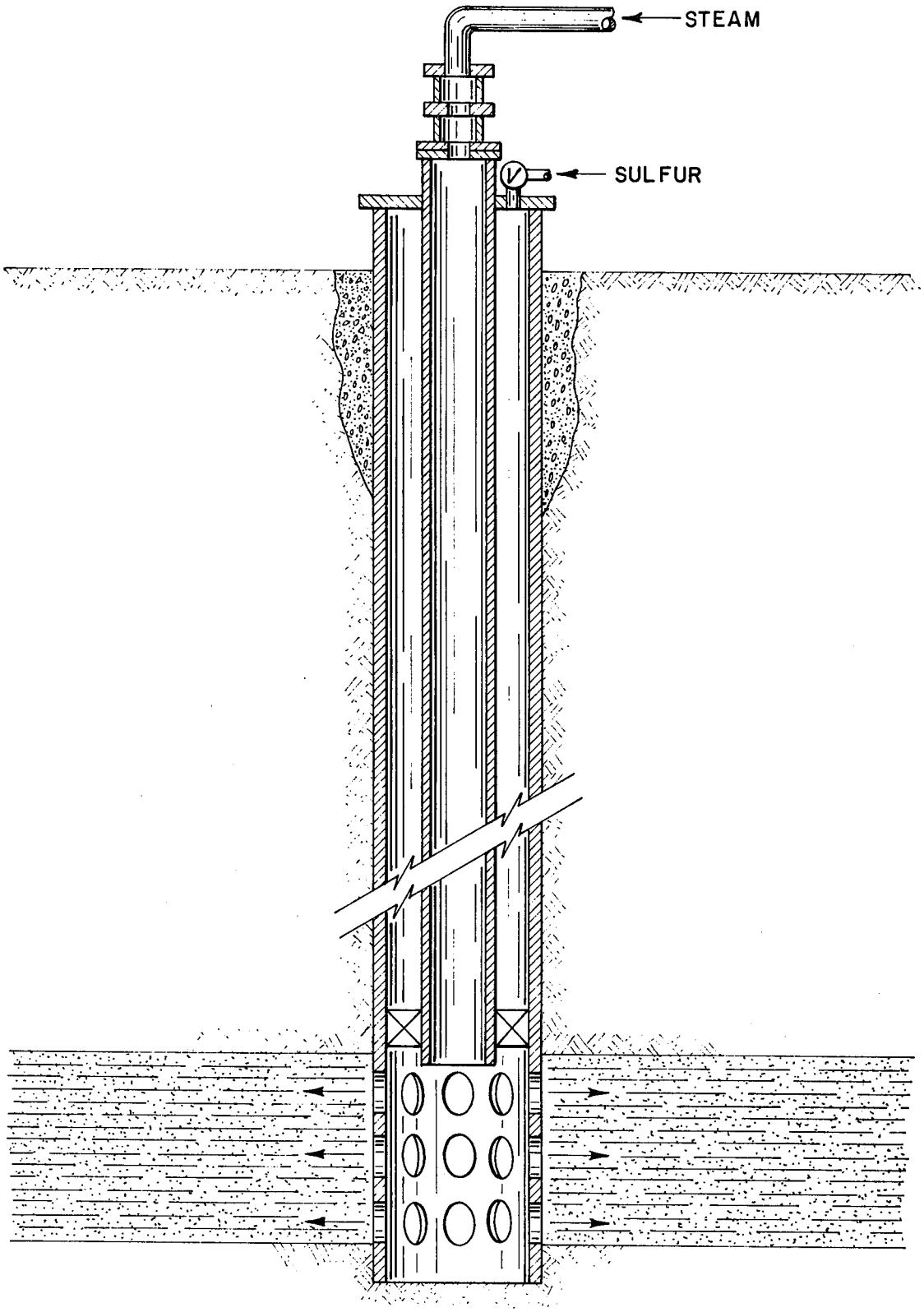

A schematic drawing of a typical steam injection well is shown in FIG. 2. Steam is inserted down the central tubing. Molten sulfur is contained in the annulus between the tubing and the casing. The oil-bearing formation contains a packer, holding the molten sulfur above the point at which oil is withdrawn from the formation. Thus, the high pressure steam will pass completely through the portion of the annulus containing molten sulfur insulation and be injected directly into the oil bearing formation through the well bore.

Thus, the instant invention provides an efficient insulator for secondary oil recovery from petroliferous formations through a well bore. Molten sulfur is used as a insulating packer fluid for steam injection wells. Sulfur has relatively good insulating properties and viscosity properties that are peculiarly suited to the application described herein. Low viscosity at temperatures near the melting point allow easy placement, while the increase in viscosity upon initiation of steam injection lowers heat losses due to convection. When steam injection is stopped, the temperature and, consequently, the viscosity drops, allowing ease of work-over operations or removal and reuse of the sulfur.

While certain embodiments and details have been shown for the purpose of illustrating this invention, it will be apparent to those skilled in this art that various changes and modifications may be made herein without departing from the spirit or the scope of the invention.

We claim:

1. In oil bearing formations penetrated by a well bore containing a casing in open fluid communication with said oil formations having an inner tubing string within the casing forming therein an annular space extending substantially to said oil formations, said tubing string being in open communication with the casing at the level of said oil formations, the method of treating said oil bearing formations comprising flowing steam down said tubing string, injecting said steam into said oil formations for a time and at a pressure sufficient to reduce the viscosity of said oil, and reducing the convection heat loss from said tubing string by inserting sulfur into the annular space between said tubing and said casing.

2. A method as described in claim 1 wherein the sulfur is in an injection well penetrating a petroliferous formation, said formation also penetrated by a producing well in communication with the same formation.

3. A method as described in claim 1 wherein oil is produced from the injection well by the process of injection followed by a period of pumping.

4. A method as described in claim 1 wherein a packing material is inserted in the annulus at a point substantially at the beginning of the petroliferous formation, the sulfur being contained in the annular configuration between the packing and the surface of the well.

5. A method as described in claim 1 wherein the sulfur inserted in said annular space is molten in form.

* * * * *